US005454538A

United States Patent [19]

Merideth

[11] Patent Number: 5,454,538

[45] Date of Patent: Oct. 3, 1995

[54] ADJUSTABLE UNIT CURB APPARATUS FOR MOUNTING AN AIR CONDITIONER

[76] Inventor: Mike Merideth, 2435 Shetland Way, Monument, Colorado 80132

[21] Appl. No.: 184,201

[22] Filed: Jan. 18, 1994

[51] Int. Cl.[6] ..... A47G 29/02

[52] U.S. Cl. ..... 248/237; 248/148; 248/676

[58] Field of Search ..... 248/237, 148 X, 248/676 X; 62/304; 52/39; 182/111

[56] References Cited

U.S. PATENT DOCUMENTS

| | | | |
|---|---|---|---|
| 1,133,878 | 3/1915 | Nagel | 248/237 |
| 1,650,433 | 11/1927 | Dages | 248/148 X |
| 2,882,810 | 4/1959 | Goettl | 248/237 |
| 4,819,448 | 4/1989 | Campell | 248/237 X |
| 4,989,826 | 2/1991 | Johnston | 248/676 |
| 5,067,685 | 11/1991 | Johnston | 52/39 X |
| 5,339,921 | 8/1994 | Faupel | 182/111 |

*Primary Examiner*—J. Franklin Foss
*Attorney, Agent, or Firm*—Thomas R. Lampe

[57] ABSTRACT

Adjustable unit curb apparatus supports an air conditioner on an inclined roof of a building. The unit curb apparatus includes first and second support members which may be pivoted relative to each other until a level support is provided for the air conditioner. The first and second support members are then secured together by mechanical fasteners to prevent relative movement therebetween.

7 Claims, 2 Drawing Sheets

ADJUSTABLE UNIT CURB APPARATUS FOR MOUNTING AN AIR CONDITIONER

TECHNICAL FIELD

This invention relates to an apparatus for mounting an air conditioner on an inclined roof of a building. More particularly, the apparatus is adjustable to compensate for the incline of the roof and allow mounting of the air conditioner unit on the level.

BACKGROUND ART

Support devices known as unit curbs are commonly employed to mount air conditioners on an inclined roof of a building. The air conditioner itself is maintained on the level or in a horizontal attitude, and ducts extend between the air conditioner and the interior of the building to provide for air flow between the air conditioner and the building interior.

Air conditioners should be maintained on the level (in a horizontal attitude) to allow proper operation thereof. This presents difficulties for air conditioner installers since the pitch or degree of inclination of inclined roofs can vary over a considerable range.

It has been the practice to custom build unit curbs so that they can be utilized with roofs with a particular degree of inclination. That is, a particular unit curb is constructed to maintain the air conditioner at a level for a particular degree of incline.

A unit curb suitable for a given degree of roof inclination will not be suitable for another degree of roof inclination or pitch. Thus the unit curb either must be fabricated on a custom per job basis or many unit curbs designed for different roof inclines must be manufactured in advance and stored in relatively large quantities, greatly adding to costs.

DISCLOSURE OF INVENTION

The present invention relates to a unit curb apparatus which is adjustable and may be utilized for a wide range of roof inclinations. Upon installation, the unit curb can be readily adjusted to ensure that the air conditioner is on the level regardless of the degree of pitch or inclination of the roof to which it is attached.

The adjustable unit curb apparatus for mounting an air conditioner on an inclined roof of a building constructed in accordance with the teachings of the present invention includes a first support member including attachment means for fixedly attaching the first support member to an inclined roof of a building.

A second support member including a platform having a support surface is provided for engaging and supporting an air conditioner positioned on the apparatus.

Connector means adjustably interconnects the first support member and the second support member whereby the platform support surface will assume a level position when the first support member is attached to an inclined roof.

Attachment means is provided for attaching the second support member and the first support member to prevent relative movement between the first support member and the second support member after the platform support surface has assumed a level position.

The connector means comprises pivot means pivotally interconnecting the first support member and the second support member.

The first support member has opposed first support member side walls and the second support member has opposed second support member side walls in at least partial registry with the first support member side walls. The first support member side walls and the second support member side walls both define apertures in at least partial registry and the pivot means includes mechanical fastener means extending through the apertures.

Other features, advantages, and objects of the present invention will become apparent with reference to the following description and accompanying drawings.

BEST MODE FOR CARRYING OUT THE INVENTION

Figure 1:
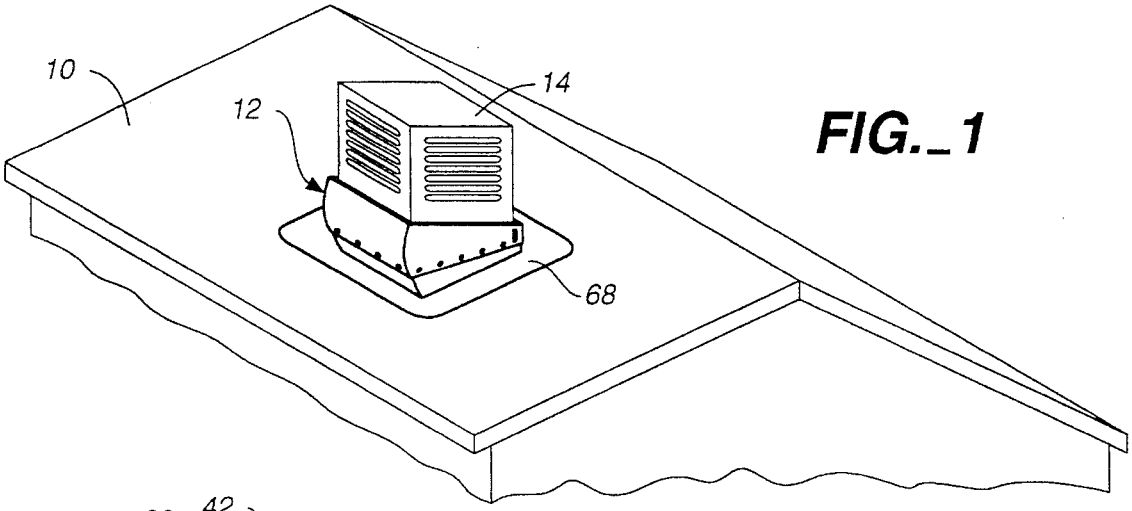
FIG. 1 is perspective view illustrating an inclined roof and unit curb apparatus constructed in accordance with the teachings of the present invention supporting an air conditioner on the roof.

Referring now to the drawings, a building having an inclined roof 10 is illustrated. Unit curb apparatus constructed in accordance with the teachings of the present invention is designated by reference numeral 12, and in FIG. 1 the unit curb apparatus 12 is shown mounted on the inclined roof and supporting an air conditioner 14. The object of the present invention is to maintain the air conditioner on the level (at a horizontal attitude) regardless of the degree of inclination or pitch of the roof 10.

Apparatus 12 includes a first support member 20 and a second support member 22, both said support members being constructed of a suitable material such as sheet metal.

First support member 20 has opposed first support member side walls 24, 26, a curved first support member front wall 28 and a first support member back wall 30, said walls being secured together in any desired fashion such as welding. At least some of the walls may be integrally formed.

Second support member 22 has a front wall 40 of a curvature corresponding to that of front wall 28 of the first support member, second support member side walls 42, 44 and a framework element 46 interconnecting the second support member side walls.

The second support member is in the form of an open framework defined by walls 40, 42, 44 and framework element 46. The top of the second support member forms a platform having a support surface for engaging and supporting an air conditioner supported on the apparatus. More particularly, the platform includes a ledge 50 defining the outer periphery of the platform and elongated platform segments 52, 54, and 56 located within the confines of the ledge 50.

In the illustrated embodiment, elongated platform segments 52, 54 and 56 comprise sheet metal channels which are secured together.

Figure 2:
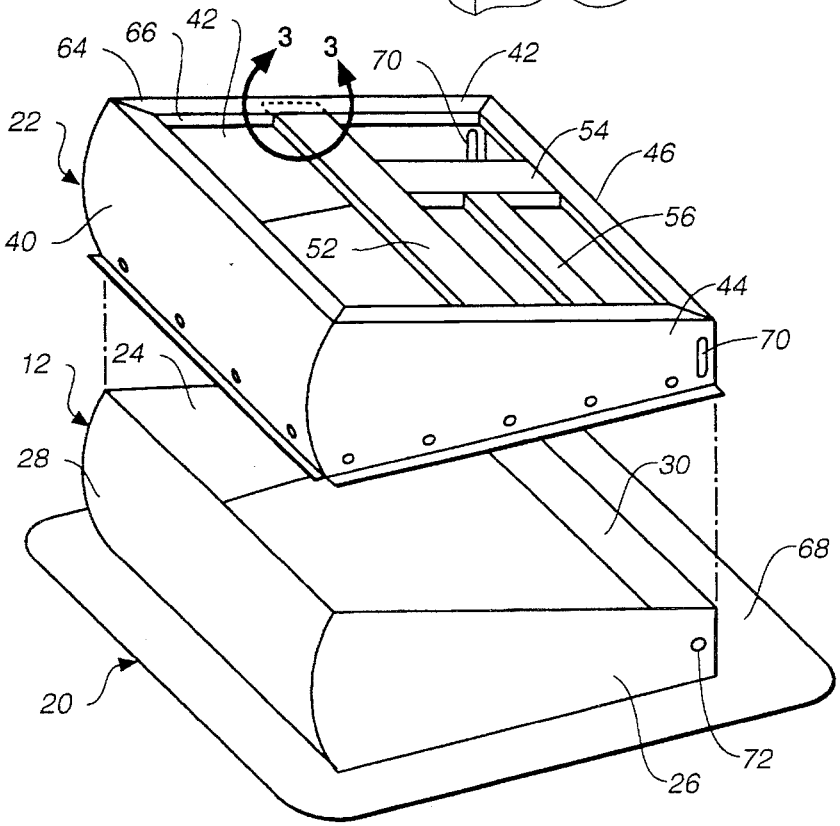
FIG. 2 is an enlarged, exploded perspective view illustrating the first and second support members of the invention.
Figure 3:
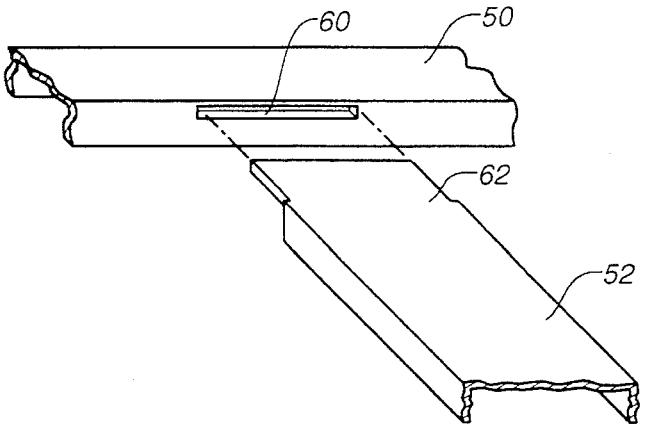
FIG. 3 is a greatly enlarged, exploded, perspective view illustrating a segment of the apparatus encompassed by line 3—3 in FIG. 2.

A preferred arrangement for assembling and connecting at least some of the segments 52, 54, 56 to each other and to the rest of the framework is illustrated in FIGS. 2 and 3 wherein slits 60 are formed in the ledge 50 which will accommodate therein projections 62 formed at the ends of the elongated platform segments engaging the ledge. In FIGS. 2 and 3 only one such projection-slit combination is illustrated; however, it is to be understood that elongated platform segment 52 also can have a projection 62 at the other end thereof accommodated by a similar slit at that respective end of the platform, i.e., the end of the platform corresponding to side wall 44. The elongated platform segments may be connected to each other in similar fashion or through use of any other suitable expedient.

The arrangement just described facilitates assembly of the second support member 22. Side walls 42, 44 may be integral with framework element 56 prior to the assembly process. The elongated platform segments 52, 54, 56 are connected together and readily slipped into position in the respective slits of ledge 50. Then, the side walls 42, 44 may be moved toward one another to lock the elongated platform segments in place and the front wall 40 then secured to the side walls as by welding or the like.

It will be noted that the ledge 50 includes a flat upper ledge element 64 extending inwardly from the periphery thereof and a flange 66 which is integral with and extends downwardly from the flat upper ledge element to resist bending of the ledge by the weight of the air conditioner positioned on the apparatus second support member. Even after installation of elongated platform segments 52, 54 and 56, the platform remains relatively open so that ducts (not shown) leading to and from the air conditioner can be readily accommodated.

First and second support members 20, 22 are adjustably interconnected by connector means whereby the platform support surface will assume a level position when the first support member is attached to an inclined roof. Securement to the inclined roof is accomplished by virtue of the fact that the lower end of first support member 20 comprises a mounting flange 68 directly positionable on the roof and secured thereto by any desired well-known expedient. This, of course, results in an inclination of the first support member corresponding to the inclination of the roof.

Figure 4:
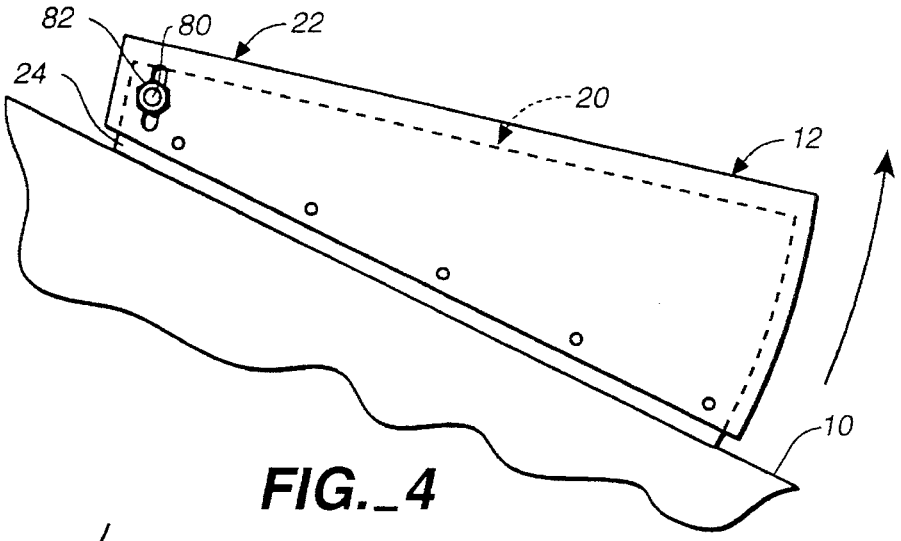
FIGS. 4, 5 and 6 are side views of the apparatus on a roof and illustrating the relative positions assumed by structure of the apparatus during sequential stages during the installation of the apparatus on the roof.
Figure 5:
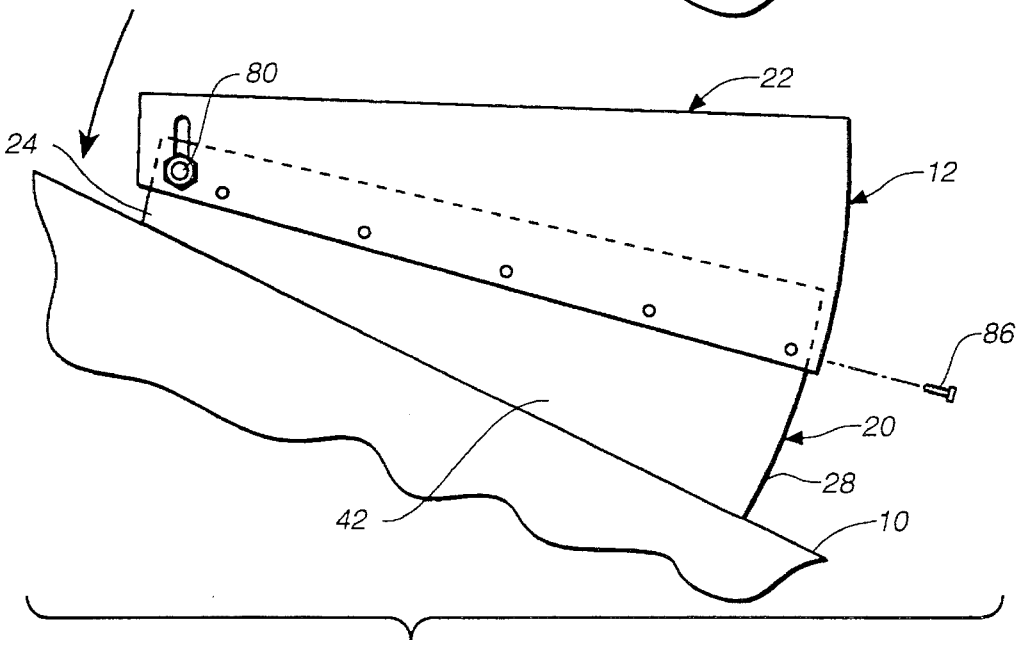
Figure 6:
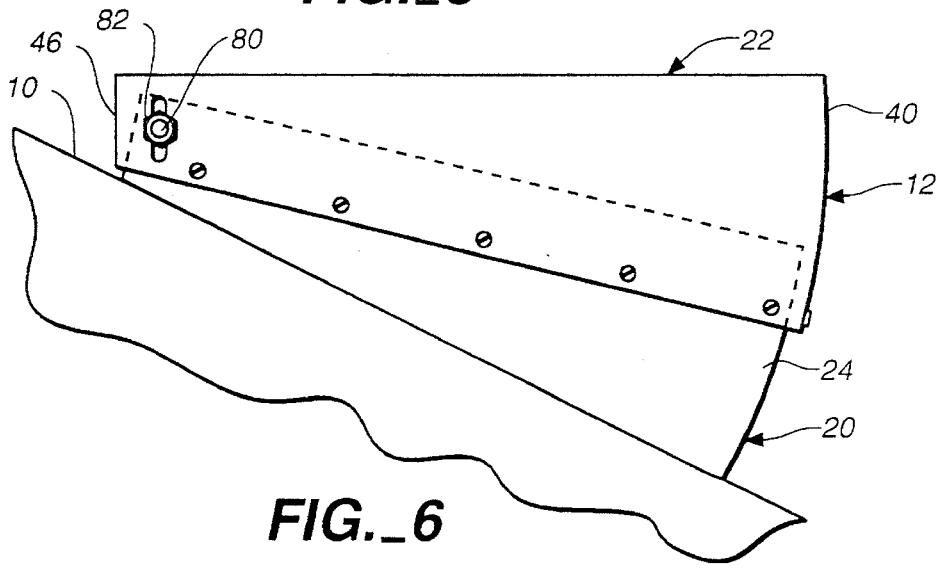

Second support member 22 has vertically disposed slots 70 located at one end of the side walls 42, 44. Second support member 22 defines a cavity at the bottom thereof which accommodates first support member 20, it being understood that the interior of the second support member is slightly larger than the exterior of the first support member. The slots 70 are placed over apertures 72 (only one of which is shown) located at the ends of side walls 24, 26. Bolts 80 are passed through the aligned slots and apertures as shown in FIG. 4 and nuts 82 are threadably engaged with the ends of the bolts. The bolts thus act as a pivot and the second support member 22 may be pivotally moved thereabout relative to first support member 20 as indicated by the arrow in FIG. 4.

The objective is to level the platform support surface of the second support member 22 prior to depositing an air conditioner thereon. The slot 70 contributes to the ability of the apparatus to provide a level support even when a relatively severe degree of roof inclination exists. That is, the second support member 22 may be tilted and moved up and down relative to the first support member 22 even at the pivot point by allowing the bolts 80 to move within the slot 70. When a level top support surface is attained, the nuts 82 are tightened. Metal screws 86 are inserted in holes 88 formed in side walls 42, 44 and screwed into side walls 24, 26 to attach the second support member to the first support member to prevent relative movement therebetween after the support surface has assumed a level position.

I claim:

1. Adjustable unit curb apparatus for mounting an air conditioner on an inclined roof of a building, said apparatus comprising, in combination:

a first support member including attachment means for fixedly attaching said first support member to an inclined roof of a building;

a second support member including a platform having a support surface for engaging and supporting an air conditioner positioned on said apparatus;

connector means adjustably interconnecting said first support member and said second support member whereby said platform support surface will assume a level position when said first support member is attached to an inclined roof; and attachment means for attaching said second support member and first support member to prevent relative movement between said first support member and said second support member after said platform support surface has assumed a level position, said connector means comprising pivot means pivotally interconnecting said first support member and said second support member, said first support member having opposed first support member side walls and said second support member having opposed second support member side walls in at least partial registry with said first support member side walls, said first support member side walls and said second support member side walls both defining apertures in at least partial registry and said pivot means including mechanical fastener means extending through said apertures, said first support member additionally including a first support member front wall and said second support member additionally including a second support member front wall, said front walls being curved, spaced from said pivot means, and in partial registry when said attachment means attaches said support members with said platform support surface in level position.

2. The apparatus according to claim 1 wherein at least some of said apertures comprise substantially vertically disposed slots allowing relative vertical movement between said first support member and said second support member at said pivot means prior to attachment of said first support member and said second support member by said attachment means.

3. The apparatus according to claim 1 wherein one of said support members defines a cavity for receiving the other of said support members.

4. The apparatus according to claim 1 wherein said support members are comprised of sheet metal.

5. The apparatus according to claim 1 wherein said connector means and said attachment means each comprises mechanical fastener means.

6. Adjustable unit curb apparatus for mounting an air conditioner on an inclined roof of a building, said apparatus comprising, in combination:

a first support member including attachment means for fixedly attaching said first support member to an inclined roof of a building;

a second support member including a platform having a support surface for engaging and supporting an air conditioner positioned on said apparatus;

connector means adjustably interconnecting said first support member and said second support member whereby said platform support surface will assume a level position when said first support member is attached to an inclined roof; and attachment means for attaching said second support member and first support member to prevent relative movement between said first support member and said second support member after said platform support surface has assumed a level position, said second support member comprising an open framework including a pair of opposed second support member side walls, a framework element interconnecting said second support member side walls, and a front wall, said second support member side walls, said first wall and said framework element defining a ledge extending at least partially about said platform, said platform additionally comprising a plurality of elongated platform segments located between said second support member side walls, said ledge defining a plurality of openings, at least some of said elongated platform segments having distal ends secured in said openings to maintain said elongated platform segments in position relative to said framework, and at least one of said elongated platform elements comprising a channel having projections at distal ends thereof, said openings comprising slits accommodating said projections.

7. The apparatus according to claim 5 wherein said ledge includes a flat upper ledge element for engagement by an air conditioner and a flange integral with and extending downwardly from said flat upper ledge element to resist bending of said ledge by the weight of an air conditioner positioned on said apparatus second support member.

* * * * *